US006183271B1

(12) United States Patent
Yu

(10) Patent No.: US 6,183,271 B1
(45) Date of Patent: Feb. 6, 2001

(54) ELECTRICAL CARD CONNECTOR ASSEMBLY AVOIDING DISPLACEMENT OF TERMINALS

(75) Inventor: Hung-Chi Yu, Hsi-Chih (TW)

(73) Assignee: Hon Hai Precision Ind. Co., Ltd., Taipei Hsen (TW)

( * ) Notice: Under 35 U.S.C. 154(b), the term of this patent shall be extended for 0 days.

(21) Appl. No.: 09/428,266

(22) Filed: Oct. 27, 1999

(30) Foreign Application Priority Data

Dec. 28, 1998 (TW) ..... 87221636

(51) Int. Cl.[7] ..... H01R 12/20
(52) U.S. Cl. ..... 439/79; 439/92
(58) Field of Search ..... 439/79, 541.5, 439/64, 159, 92

(56) References Cited

U.S. PATENT DOCUMENTS

| | | | | |
|---|---|---|---|---|
| 5,709,568 | * | 1/1998 | Pan et al. | 439/541.5 |
| 5,775,923 | * | 7/1998 | Tomioka | 439/541.5 |
| 5,795,190 | * | 8/1998 | Ono | 439/541.5 |
| 5,906,510 | * | 5/1999 | Lwee | 439/541.5 |
| 5,954,522 | * | 9/1999 | Ho et al. | 439/541.5 |
| 5,967,803 | * | 10/1999 | Ho | 439/541.5 |

* cited by examiner

*Primary Examiner*—Gary F. Paumen
(74) *Attorney, Agent, or Firm*—Wei Te Chung

(57) ABSTRACT

An electrical connector assembly comprises an IC card connector and a transition connector. The IC card connector includes a dielectric housing, a number of conductive terminals received in the housing, a grounding plate partially covering the housing, a pair of guiding rails and a card ejection mechanism. A mating board projecting from a mating face at a front end of the housing has a number of slots and grounding recesses in the surfaces thereof. The slots are uniformly spaced and located in top and bottom surfaces of the mating board. The slots extend through the housing from the mating face to a contacting face at a rear end of the housing. The grounding recesses are disposed in the top surface of the mating board and are alternatingly spaced between the slots. The conductive terminals are secured in the slots thereby avoiding deflection. A number of grounding fingers depending from a front edge of the grounding plate is received in the corresponding grounding recesses. The transition connector possesses a number of mating contacts and a mating cavity corresponding to the conductive terminals and the mating board. The mating contacts each have a curved end for engaging with a conductive terminal and an opposite end extending to a printed circuit board.

1 Claim, 5 Drawing Sheets

ELECTRICAL CARD CONNECTOR ASSEMBLY AVOIDING DISPLACEMENT OF TERMINALS

BACKGROUND OF THE INVENTION

1. Field of the Present Invention

The present invention relates to a card connector assembly, and particularly to a card connector assembly which possesses a plurality of conductive terminals protectively secured to assure easy and reliable contact.

2. Brief Description of the Prior Art

Card connector assemblies are disclosed in Taiwan Patent Application Nos. 82210513, 84206175 and 84206176. The conventional card connector assembly shown in FIG. 5 comprises a dielectric housing 11 and a plurality of conductive terminals 15 arranged in upper and lower rows extending through the dielectric housing 11. A mating end (not labeled) of each terminal 15 extends into a receiving chamber 12 of the housing 11 and mates with an inserted IC card (not shown). A solder tail (not labeled) of each terminal 15 is curved to engage with a printed circuit board (PCB) 20. Since the solder tail of each terminal 15 is not protected by the housing 11 when it is mated to the PCB 20, the terminals 15 may easily be deflected and electrical contact may therefore be unreliable.

In another prior art card connector assembly disclosed in FIG. 6, an IC card connector 16 is connected to a transition connector 30 on a PCB 20 by a flexible circuit board 21. However, use of the flexible circuit board 21 sharply increases production cost.

Hence, an improved electrical connector is required to overcome the disadvantages of the prior art.

BRIEF SUMMARY OF THE INVENTION

A first object of the present invention is to provide a card connector assembly with a plurality of conductive terminals easily and reliably contacted;

A second object of the present invention is to provide an IC card connector with a plurality of terminals reliably secured in position and protected from deflection during assembly; and A further object of the present invention is to provide a transition connector for reliably receiving a plurality of terminals in an IC card connector.

In order to achieve the above objects, an electrical connector assembly of the present invention comprises an IC card connector and a transition connector. The IC card connector includes a dielectric housing, a plurality of conductive terminals received in the housing, a conductive grounding plate covering the housing, a card ejection mechanism and a pair of guiding rails attached to the card ejection mechanism. The housing has a mating board projecting from a front mating face thereof, a contacting face opposite to the mating face and a pair of arms rearwardly extending at opposite ends of the housing. The mating board defines a plurality of parallel slots and a plurality of parallel grounding recesses. The slots are spaced at regular intervals and are symmetrically located on both a top and a bottom surface of the mating board. The slots extend through the housing from the mating face to the contacting face for securing the terminals. The grounding recesses are spaced at regular intervals between the slots and are located in the top surface of the mating board for receiving a plurality of grounding fingers extending from the front edge of the grounding plate. Therefore the conductive terminals and the grounding fingers are secured in the slots and the grounding recesses thereby preventing the terminals from being broken and assuring easy and reliable contact between the terminals of the card connector and the contacts of the transition connector. The slots and the grounding recesses are integrally constructed with the housing.

The transition connector possesses a plurality of upper mating contacts and lower mating contacts and a mating cavity corresponding to the mating board. One end of the upper and lower mating contacts are curved to engage with the conductive terminals of the card connector. A solder tail of each upper mating contact depends downwardly to be soldered to a PCB while a solder tail of each lower mating contacts extend along exterior bottom surface of the receiving housing to be soldered to the PCB.

Other objects, advantages and novel features of the invention will become more apparent from the following detailed description of the present embodiment when taken in conjunction with the accompanying drawings.

DETAILED DESCRIPTION OF THE INVENTION

Figure 1:
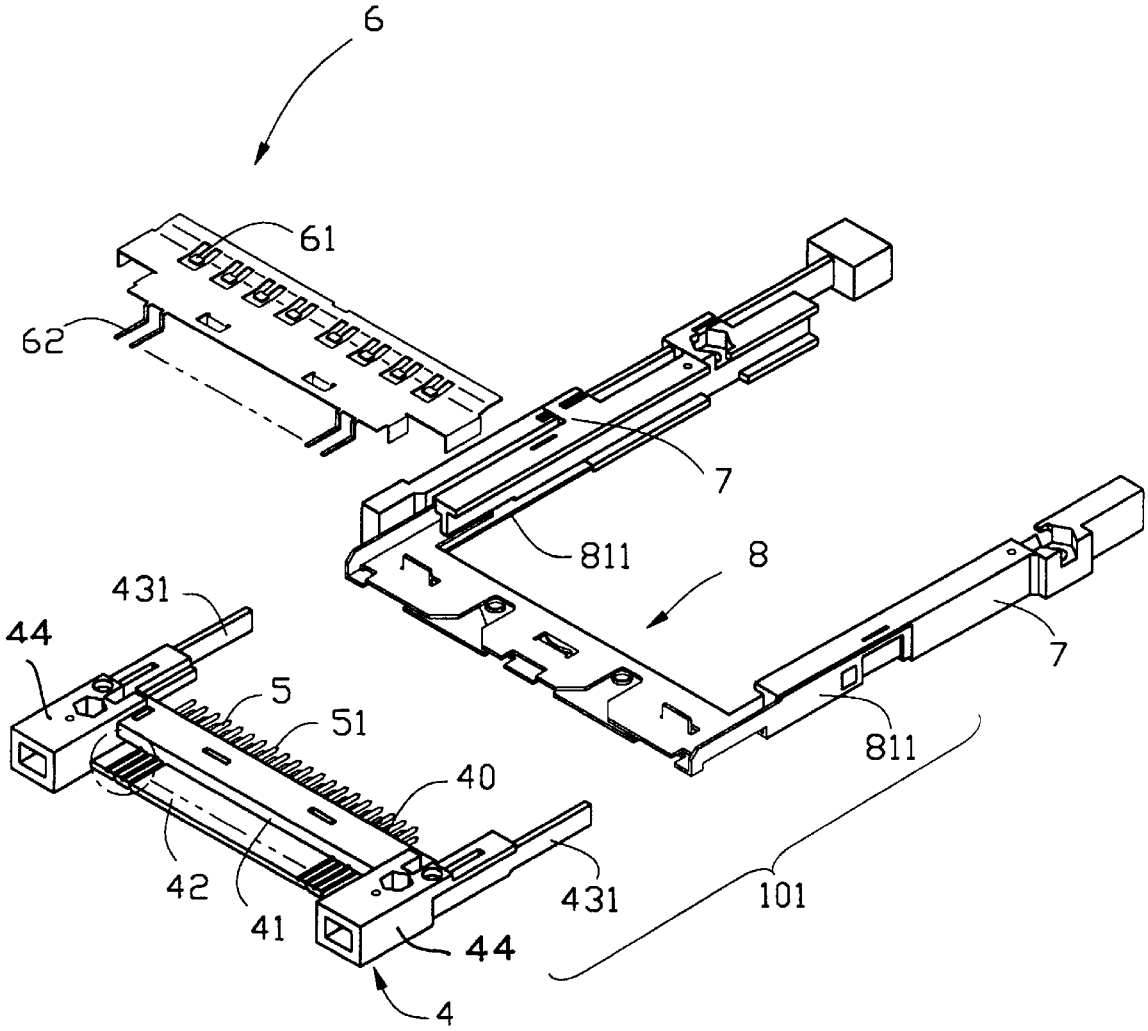
FIG. 1 is an exploded view of an electrical IC card connector in accordance with the present invention.
Figure 3:
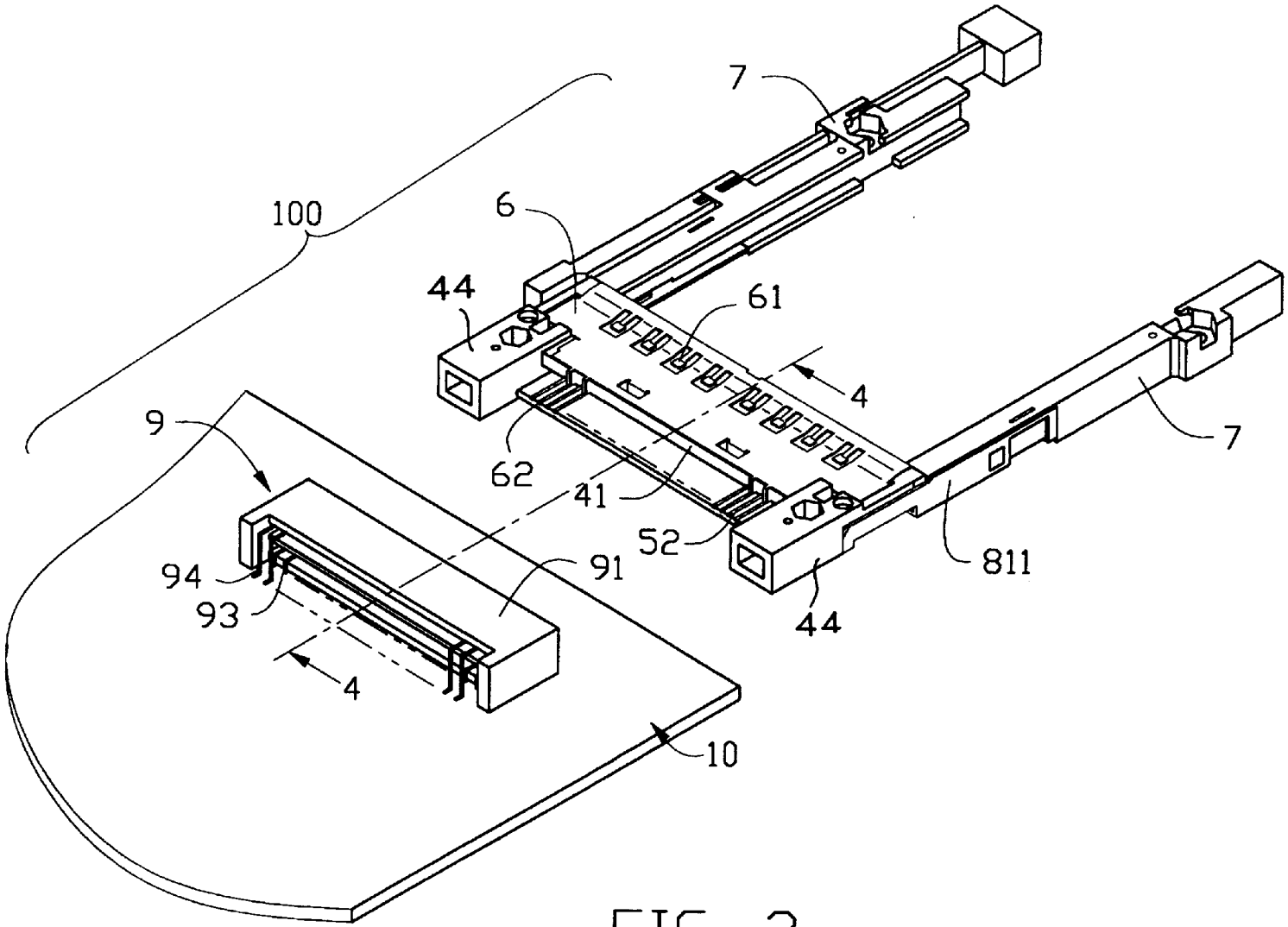
FIG. 3 is a perspective view of an electrical card connector assembly about to mate with a transition connector.

Referring to FIGS. 1 and 3, a card connector assembly 100 in accordance with the present invention comprises an IC card connector 101 and a transition connector 9. The IC card connector 101 comprises a dielectric housing 4, a plurality of conductive terminals 5 received in the housing 4, a conductive grounding plate 6 covering the housing 4, a card ejection mechanism 8 and a pair of guiding rails 7 attached to the card ejection mechanism 8.

The housing 4 includes a front mating face 41 having a mating board 42 forwardly projecting therefrom and a contacting face 40 opposite the mating face 41. A pair of retaining arms 431 rearwardly extend from lateral ends of the housing 4 and is attached to the card ejection mechanism 8. A pair of protective arms 44 forwardly extend from lateral ends of the housing 4 for protecting the mating board 42 therebetween.

Figure 2:
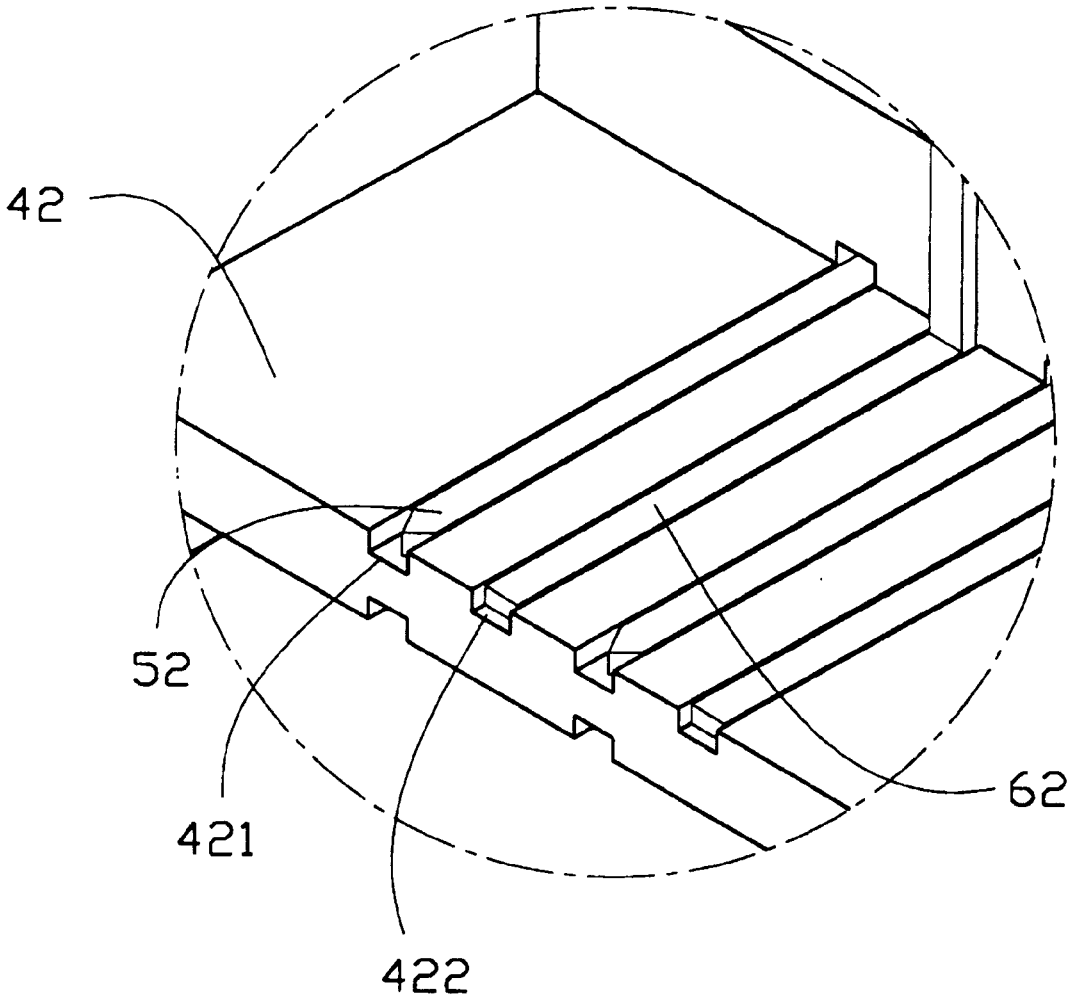
FIG. 2 is a partial enlarged perspective view of a plurality of mating ends in corresponding slots and a plurality of grounding fingers in the corresponding grounding recesses.

Further referring to FIG. 2, a plurality of slots 421 spaced at regular intervals is symmetrically defined in top and bottom surfaces of the mating board 42. The slots 421 penetrate from the mating face 41 to the contacting face 40 for accommodating the terminals 5. A plurality of integrally formed grounding recesses 422 is uniformly spaced in the top surface of the mating board 42. Each grounding recess 422 is located between slots 421.

Each conductive terminal 5 has a contacting end 51 extending through the contacting face 40 and an opposite mating end 52 received in the corresponding slot 421 of the mating board 42 for being retained in position.

The grounding plate 6 covers a top surface of the housing 4. The grounding plate 6 has a plurality of resilient lips 61 arranged in a row and a plurality of grounding fingers 62 extending from a front edge thereof. The grounding fingers 62 are bent to fit into the grounding recesses 422. Each grounding finger 62 is L-shaped to fit parallel to the conductive terminals 5 in the mating board 42. The resilient lips 61 contact the IC card to provide grounding capabilities.

The guiding rail 7 is attached to a stretching arm 811 of the card ejection mechanism 8. The arm 431 of the housing 4 is received between the stretching arm 811 and the guiding rail 7 to fasten the card ejection mechanism 8 to the housing 4. Since the structure and function of the card ejection mechanism 8 and of the guiding rail 7 are well known to those skilled in the art, a detailed description thereof is omitted herein.

Figure 4:
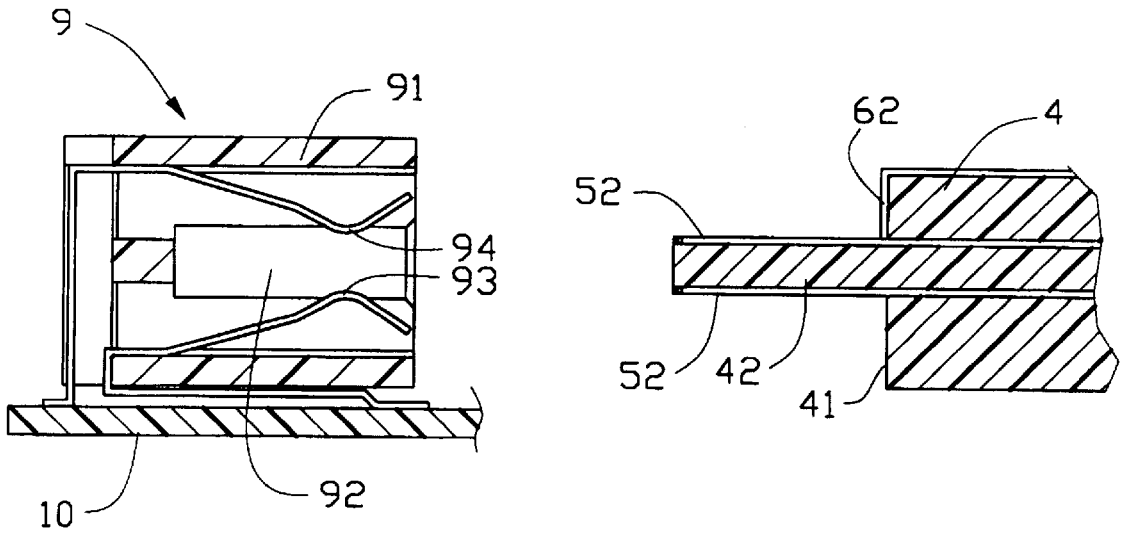
FIG. 4 is a cross-section view taken along line 4—4 of FIG. 3.
Figure 5:
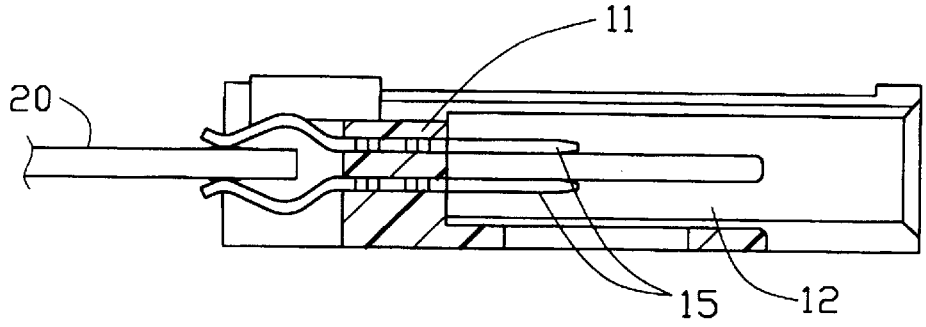
FIG. 5 (PRIOR ART)
FIG. 5 is a cross-section view of a prior art card connector assembly.
Figure 6:
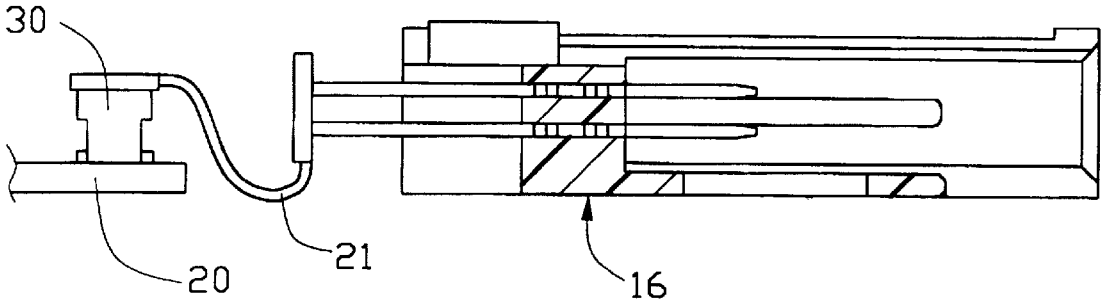
FIG. 6 (PRIOR ART)
FIG. 6 is a cross-section view of a second prior art card connector assembly.

Referring to FIGS. 3 and 4, the transition connector 9 for connecting the IC card connector 101 is mounted on a PCB 10. The transition connector 9 includes a dielectric receiving housing 91, a mating cavity 92 and a plurality of mating contacts 94, 93 arranged in upper and lower rows. The mating cavity 92 inside the receiving housing 91 is adapted for accommodating the mating board 42 of the card connector 101. One end of each upper mating contact 94 is respectively curved to engage with the mating end 52 of a conductive terminal 5 when the mating board 42 is inserted into the mating cavity 92; the other end bends to contact circuit traces on the PCB 10. One end of each lower mating contact 93 is curved to contact with the mating end 52 of a conductive terminal 5 of inserted mating board 42 and the other end depends downwardly to the PCB 10. Thus, when the mating board 42 is inserted into the mating cavity 92 in the transition connector 9, the mating ends 52 of the conductive terminals 5 received in the slots 421 engage with corresponding mating contacts 93, 94 thereby avoiding undesired displacement of the terminals 5. Reliable electrical connection between the IC card connector 101 and the transition connector 9 is, therefore, ensured since displacement of the conductive terminals 5 is prevented.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

an IC card connector including a dielectric housing and a plurality of conductive terminals, the housing having a front mating face, a mating board projecting from the front mating face, and a contacting face at a rear end thereof, the mating board defining a plurality of slots longitudinally spacedly located in top and bottom surfaces thereof, the slots extending from the mating face to the contacting face, each terminal having one end extending through the contacting face for engaging with an IC card and another mating end received in the slot; and a transition connector including a receiving housing, a mating cavity in the receiving housing and a plurality of mating contacts arranged in upper and lower rows inside the receiving housing, the mating cavity receiving the mating board of the IC card connector, an engaging end of each mating contact extending into the mating cavity and being engaged with the mating end of the conductive terminal of the IC card connector, and an solder tail of each mating contact extending out the receiving housing to contact a PCB;

wherein a grounding plate is attached to the dielectric housing and has a plurality of grounding fingers extending from a front edge thereof, and wherein a plurality of grounding recesses is alternatingly spaced between the slots for receiving the grounding fingers therein.

* * * * *